US006991682B2

(12) United States Patent
Moss et al.

(10) Patent No.: US 6,991,682 B2
(45) Date of Patent: Jan. 31, 2006

(54) APPLICATOR PLATE FOR AN ADHESIVE APPLICATOR OF A CORE-MAKING MACHINE

(75) Inventors: Richard J. Moss, Green Bay, WI (US); Donald J. School, Green Bay, WI (US)

(73) Assignee: Paper Converting Machine Company, Green Bay, WI (US)

( * ) Notice: Subject to any disclaimer, the term of this patent is extended or adjusted under 35 U.S.C. 154(b) by 0 days.

(21) Appl. No.: 10/621,493

(22) Filed: Jul. 17, 2003

(65) Prior Publication Data

US 2005/0011440 A1 Jan. 20, 2005

(51) Int. Cl.
*B05C 5/02* (2006.01)

(52) U.S. Cl. ..... 118/407; 118/410; 118/419

(58) Field of Classification Search ..... 118/407, 118/410, 419; 427/356; 425/216; 156/578
See application file for complete search history.

(56) References Cited

U.S. PATENT DOCUMENTS

| | | | | |
|---|---|---|---|---|
| 1,846,707 A | | 2/1932 | Conti | |
| 1,913,447 A | | 6/1933 | Huston et al. | |
| 2,931,278 A | | 4/1960 | Ignell | |
| 4,246,335 A | * | 1/1981 | Keogh et al. | 264/177.16 |
| 4,943,451 A | * | 7/1990 | Zimmer | 427/294 |
| 5,067,432 A | * | 11/1991 | Lippert | 118/413 |

FOREIGN PATENT DOCUMENTS

| | | |
|---|---|---|
| DE | 43 37 386 A1 | 5/1994 |
| EP | 0 823 318 A1 | 2/1998 |
| EP | 0 993 367 | 4/2002 |
| EP | 1 308 217 A2 | 5/2003 |

* cited by examiner

*Primary Examiner*—Laura Edwards

(57) ABSTRACT

An adhesive applicator for a core-making machine is provided with an applicator plate for applying adhesive to a web. The applicator plate has upstream and downstream faces and a bottom surface which extends from the upstream face beyond the downstream face. The bottom surface is adapted to spread adhesive on a moving web below the bottom surface. The bottom surface forms a narrow wedge-shaped portion with an upper surface which extends away from the downstream face.

13 Claims, 7 Drawing Sheets

APPLICATOR PLATE FOR AN ADHESIVE APPLICATOR OF A CORE-MAKING MACHINE

BACKGROUND

This invention relates to adhesive applicators for core-making machines. More particularly, the invention relates to an applicator plate which applies a uniform thickness of adhesive to a web which moves below the applicator plate.

In the paper converting art, a web of tissue or paper is wound on a rotating tubular core to form an elongated log. The log is thereafter transversely severed at multiple locations to form individual rolls of paper products, for example, bathroom tissue or kitchen towels.

The hollow cores are made on a core-making machine. In the present art of core-making machines, two or more fibrous webs are wound on a mandrel and bonded together with adhesive to form a continuous tube. The tube is subsequently cut to a desired length.

The adhesive applicator of a core-making machine typically consists of a wheel which is partially submerged in an adhesive bath. The wheel picks up, carries, and transfers adhesive to a web as the web wraps the wheel. Excess adhesive is removed to leave a thin layer for subsequent bonding of the webs.

The problem with this type of system is that the method which is used to remove excess adhesive requires adjustment as the speed of the machine is varied. Machine speed is also limited to a relatively low level.

Core-making machines using a wheel for applying adhesive are described in U.S. Pat. Nos. 1,846,707, 1,913,447, and 2,931,278. European Patent EP 0 993 367 B1 describes an alternate method of applying adhesive in a separate operation and then "activating" the adhesive when the core is made.

Spraymation, Inc. of 5320 N.W. 35th Avenue, Fort Lauderdale, Fla. 33309-6314 markets a slot coater adhesive system which includes an adhesive applicator, an adhesive pumping system, and controls. It was believed that the Spraymation system could solve the problem of adjusting the system as speed was varied and the problem of low limit on machine speed and could also reduce the quantity of adhesive required for proper bonding.

The discharge end of the Spraymation adhesive applicator comprises an applicator head and a slot plate. Adhesive is dispensed through an opening between the applicator head and the slot plate. The adhesive applicator is adjusted to contact the web for proper adhesive lay-down.

However, the use of the Spraymation applicator caused other problems. There are various grades of fibrous material used in core-making. Some grades release more fiber particles during the core-making process than others. The fiber particles collect at various locations on the core-making machine and require periodic clean-up—typically at each shift change. When the particles come into contact with the adhesive, which is also in contact with the slot plate, small beads of adhesive and particles begin to form on the downstream side of the slot plate. As these beads grow in size, streaks are formed on the web. The streak is a mark or line on the web at which the amount of adhesive is reduced or eliminated, resulting in a non-uniform adhesive lay-down. As the streak quantity and size increases, the quality of the core or tube diminishes, eventually causing production loss downstream within the core-making machine or in other downstream machinery. The core-making machine must be stopped and the slot plate and its opening must be cleaned.

SUMMARY OF THE INVENTION

The invention provides an improved applicator plate for the applicator head. The bottom of the applicator plate which contacts the fibrous web material ends in the direction of web travel in a narrow wedge-shaped or knife-like edge. The knife-like edge does not permit a thick accumulation of adhesive and particles, only a thin, light layer that does not create streaking. The layer breaks off harmlessly after reaching about 0.25 to 0.50 inch in length.

DESCRIPTION OF THE DRAWING

The invention will be explained in conjunction with an illustrative embodiment shown in the accompanying drawing in which—

DESCRIPTION OF SPECIFIC EMBODIMENT

Figure 1:
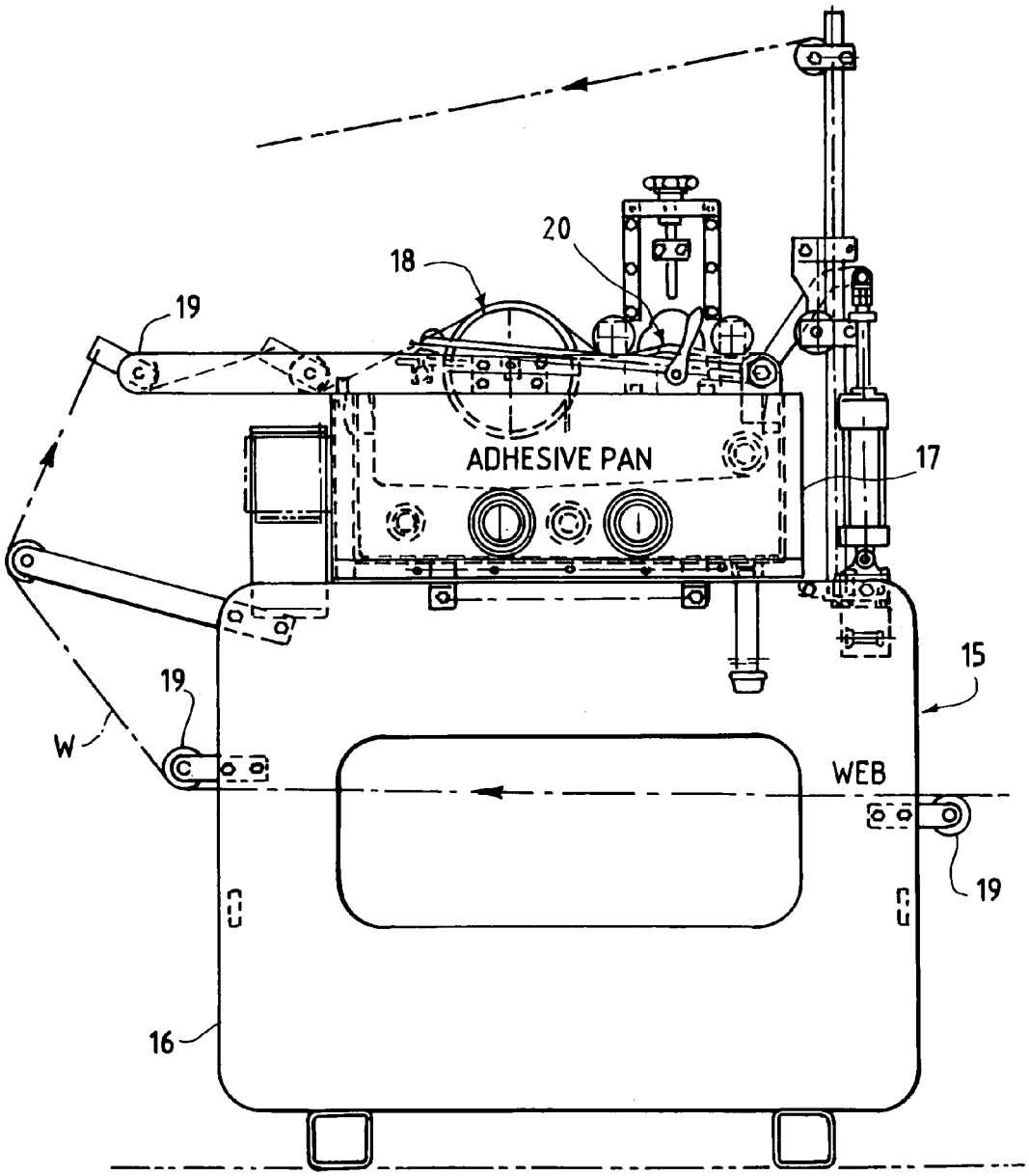
FIG. 1 PRIOR ART
FIG. 1 illustrates a prior art wheel-type adhesive applicator.

Referring first to FIG. 1, a prior art adhesive applicator 15 includes a glue stand 16, an adhesive pan 17, and an applicator wheel 18 which is rotatably mounted in the adhesive pan. A web W is guided by rollers 19 and wraps a portion of the wheel 18. As the web travels over the wheel, the wheel rotates, picks up adhesive from the adhesive pan, and applies the adhesive to the web. A doctor blade 20 removes excess adhesive from the web.

Figure 2:
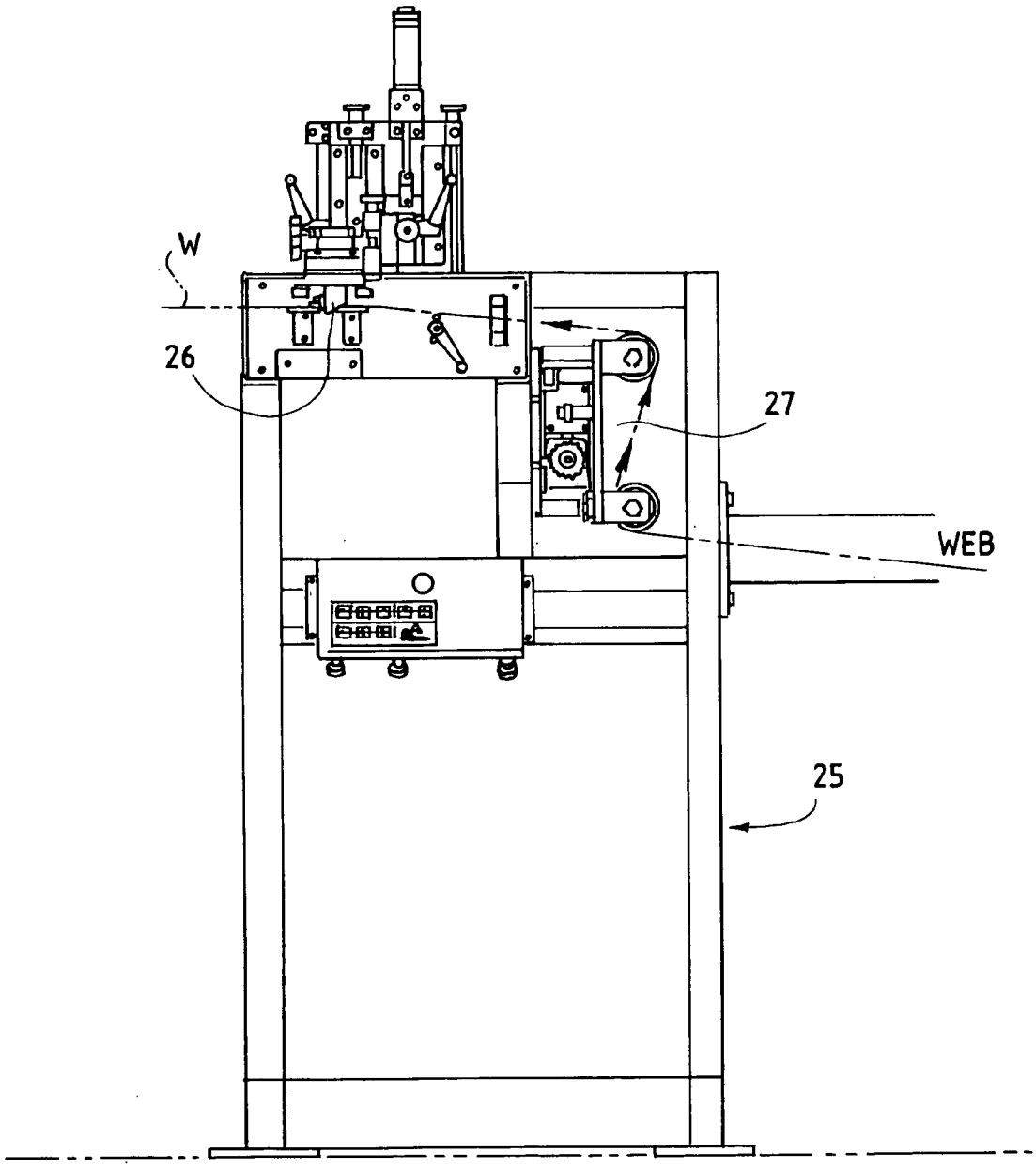
FIG. 2 illustrates an adhesive applicator with a slot coater adhesive system.

FIG. 2 illustrates an adhesive applicator 25 which is equipped with a slot coater adhesive applicator 26. A web W is guided by a web guide 27 into the adhesive applicator 26 which applies adhesive to the web.

Figure 3:
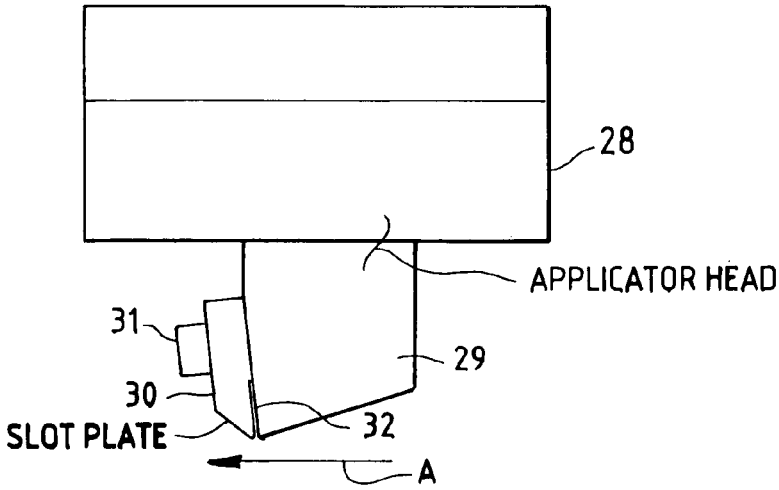
FIG. 3 illustrates the Spraymation adhesive applicator.

Referring to FIG. 3, a slot coater adhesive applicator 28 includes an applicator head 29 and a slot plate 30. The slot plate is attached to the applicator head by bolts 31. Adhesive is dispensed through a slot 32 between the slot plate and the applicator head to the web which travels in the direction of the arrow A.

Figure 4:
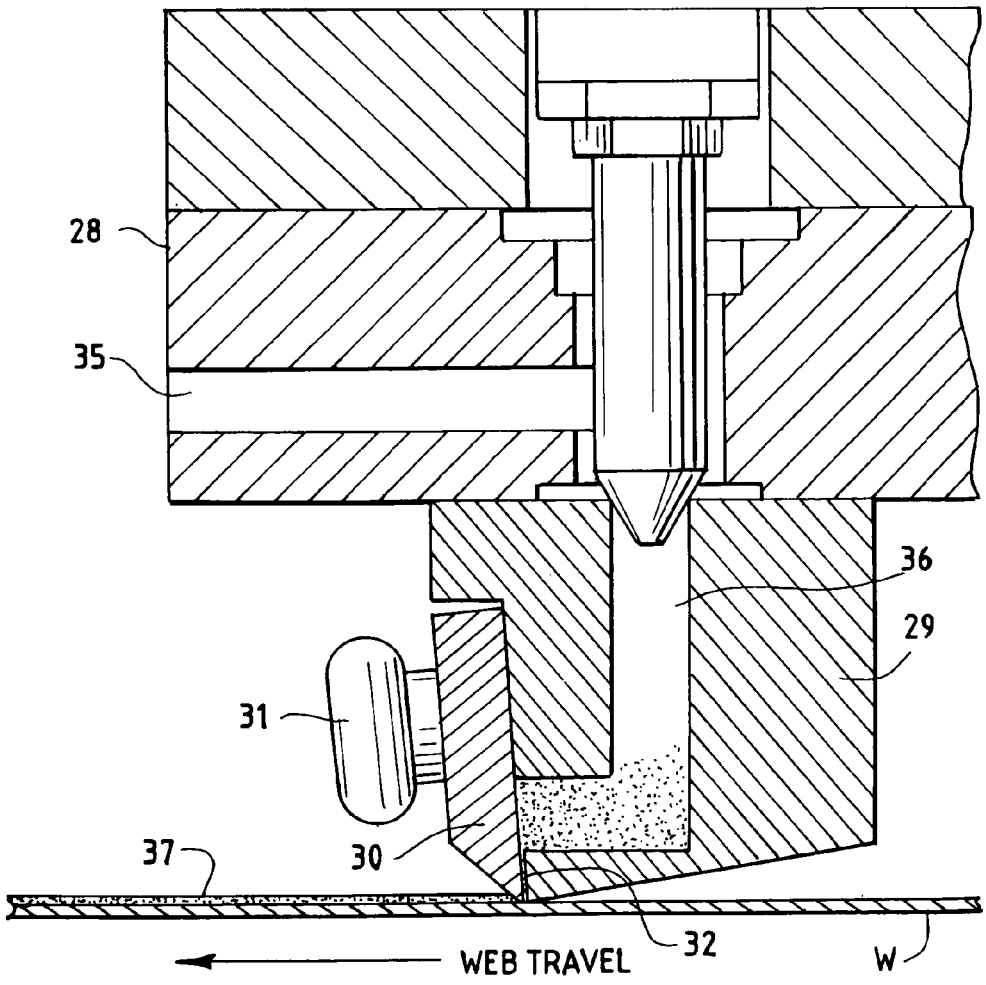
FIG. 4 is a fragmentary sectional view of the Spraymation adhesive applicator.

FIG. 4 is a cross sectional view of the adhesive applicator 28. Adhesive flows from one internal passage 35 through a second internal passage 36 in the applicator head to the slot plate 30. Adhesive flows downwardly through the slot 32, and a layer 37 of adhesive is applied to the web W as the web moves past the bottom of the slot plate.

Figure 5:
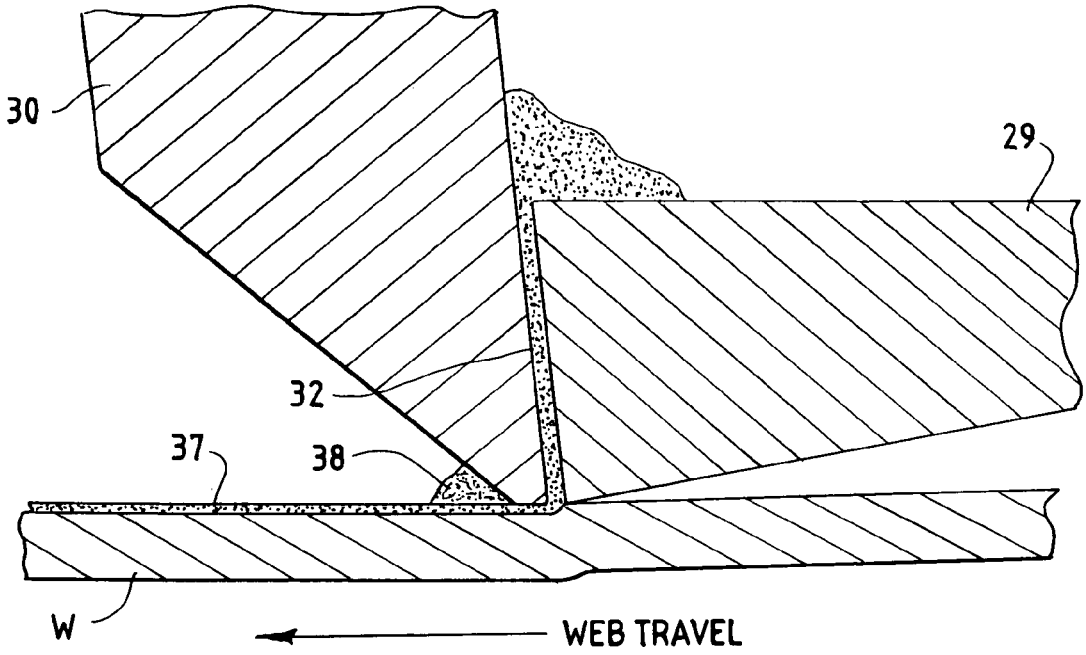
FIG. 5 is an enlarged fragmentary view of a portion of FIG. 4 showing the build-up of adhesive and fibrous particles on the downstream side of the slot plate.

FIG. 5 illustrates the build-up of a bead 38 of contamination which comprises adhesive and fibrous particles. Such beads form on the downstream face of the slot plate. As the beads grow in size, streaks are formed in the adhesive on the web.

Figure 6:
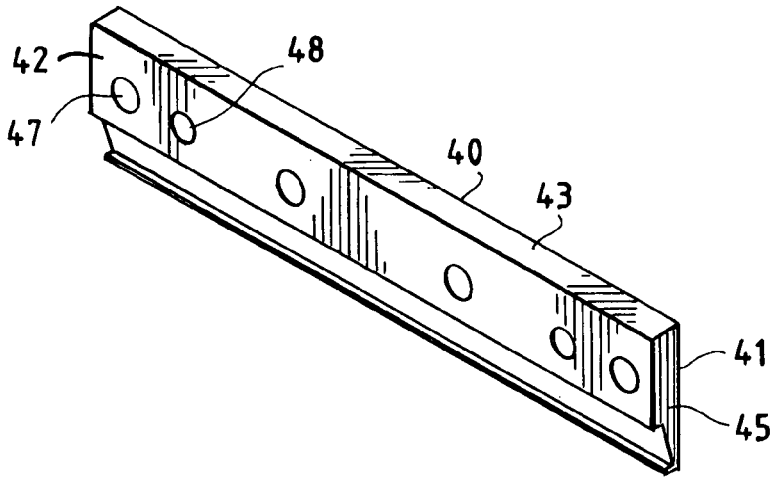
FIG. 6 is a perspective view of the inventive applicator plate.
Figure 7:
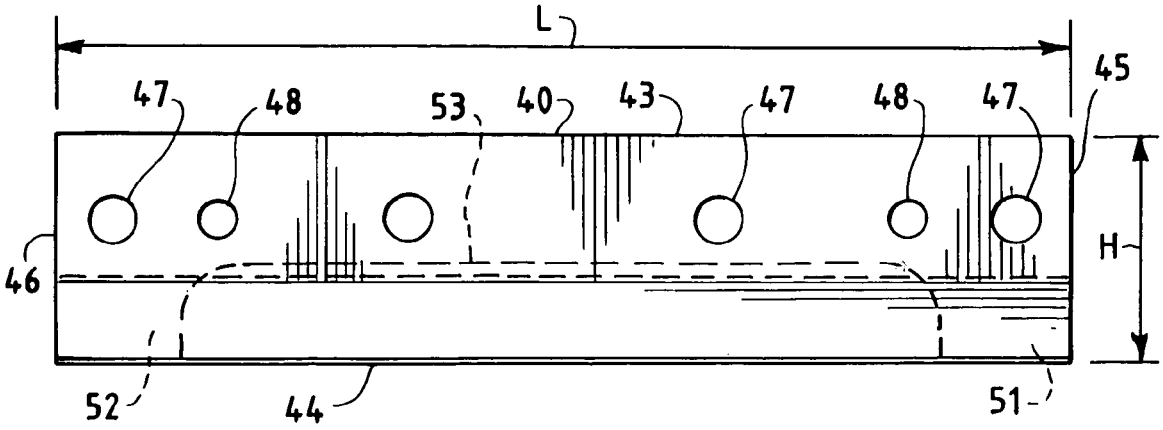
FIG. 7 is an elevational view of the applicator plate of FIG. 6.
Figure 8:
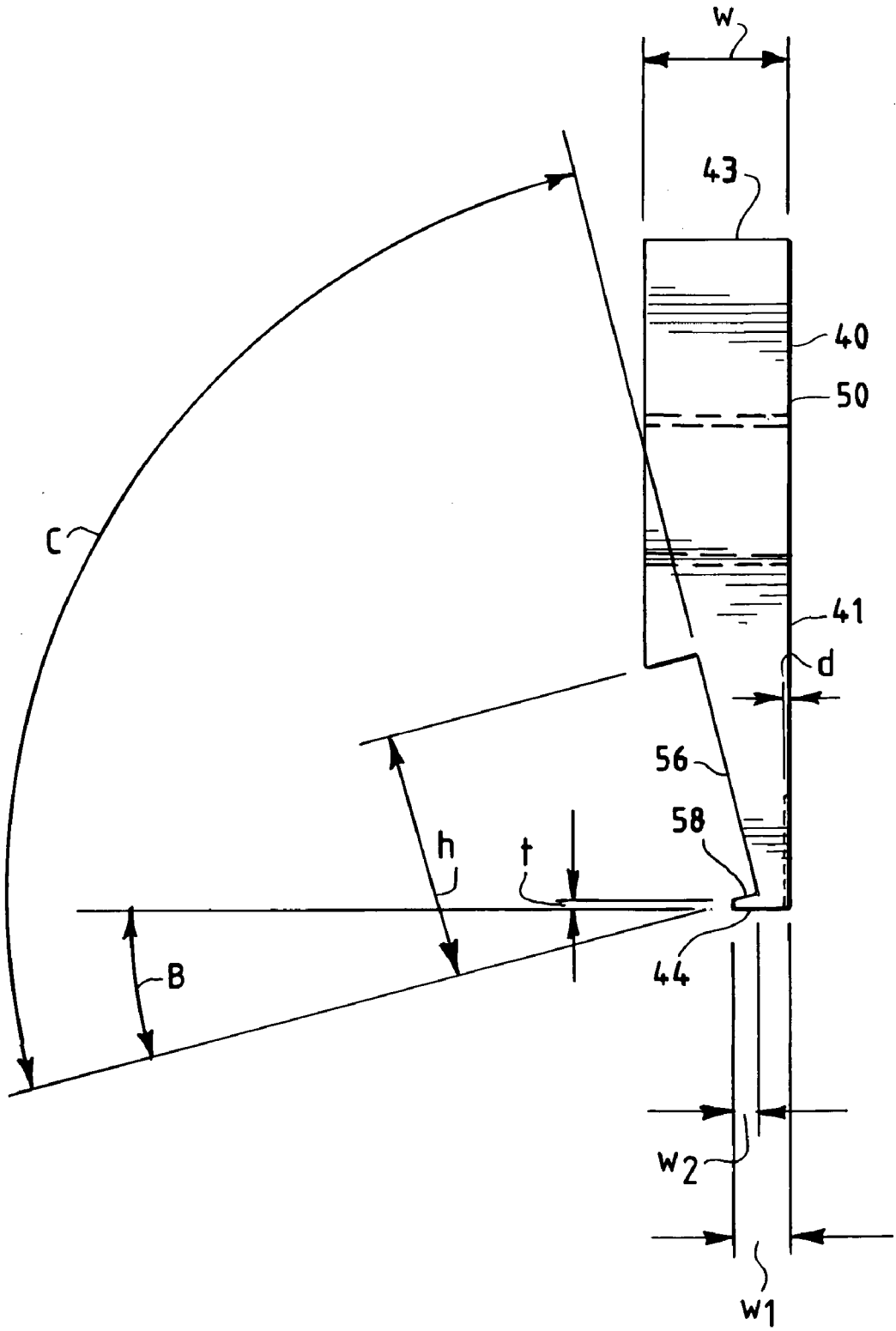
FIG. 8 is an end elevational view of the applicator plate of FIG. 7.

Referring to FIGS. 6–8, an improved applicator plate 40 includes upstream and downstream faces 41 and 42, top and bottom faces 43 and 44, and side faces 45 and 46. Four bolt holes 47 extend through the plate for attaching the plate to the applicator head 29. Two pin holes 48 permit the plate to be easily located on the applicator head for securing with the bolts.

The upstream face 41 of the plate includes a flat top portion 50 and a pair of flat side portions 51 and 52 (FIG. 7) which extend to the bottom face 44. A recess 53 is formed in the upstream face to allow adhesive to flow between the plate and the applicator head.

The downstream face 42 includes a flat top portion 55 which is parallel to the upstream face and an angled bottom portion 56.

Figure 9:
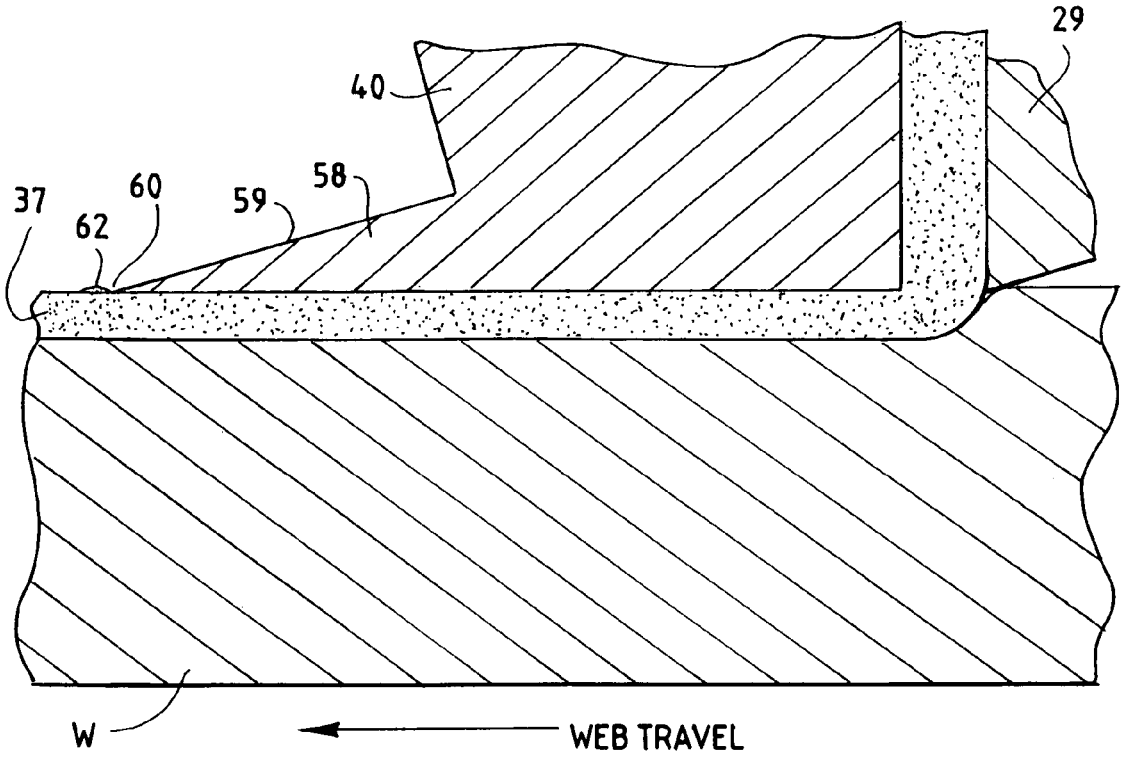
FIG. 9 is an enlarged fragmentary view similar to FIG. 5 showing the inventive applicator plate and a very small amount of build-up of adhesive and particles.

The bottom face 44 is flat and extends from the upstream face 41 beyond the bottom portion 56 of the upstream face. A wedge-shaped or knife-like projection 58 is formed by the bottom face 44 and an upper surface 59 (FIG. 9). In the preferred embodiment, the upper surface 59 extends at an angle B relative to the plane of the bottom face 44. The angle B is advantageously within the range of about 10° to about 20° and most preferably is 15°. The thickness t of the knife-like projection 58 at the downstream edge 60 in the preferred embodiment was 0.009±0.002 inch. However, the thickness of the edge can range from a point to about 0.025 inch.

One specific embodiment of the plate 40 had a length L of 4.5 inches, a height H of 1.0 inch, and width w of 0.220 inch. The bottom face 44 had a total width $w_1$ of 0.090 inch, and the width $w_2$ of the knife-like projection 58 which extends beyond the angled bottom portion 56 was 0.040 inch. The angled bottom portion 56 had a height h of 0.375 inch and extended at an angle C with respect to the upper surface of the projection 58 of 90°. The recess 53 had a depth d of 0.008±0.001 inch.

The foregoing dimensions of the specific embodiment can be varied. For example, the width $w_1$ of the bottom face can be within the range of 0.070 to 0.160 inch, and the width $w_2$ of the projection 58 can be within the range of 0.030 to 0.110 inch.

The thickness of the projection 58 at the downstream face 56 is within the range of about 0.005 to about 0.065 inch. The thinnest value is provided when $w_1$=0.070 inch, $w_2$=0.030 inch, t=0, and B=10°. The thickest value is provided when $w_1$=0.160 inch, $w_2$=0.110 inch, t=0.025 inch, and B=20°.

FIG. 9 illustrates the applicator plate 40 mounted on an applicator head 29 for applying a layer 37 of adhesive to a web W which moves past the applicator plate in the direction of the arrow. The pressure on the adhesive in the applicator head in the preferred embodiment is 10 psi, but can be varied from about 8 to 20 psi. The bottom surface of the applicator plate which contacts the adhesive ends in the narrow knife-like downstream portion 58. The knife-like edge does not permit a thick accumulation of adhesive and fibrous particles, and only a thin light layer 62 of adhesive and particles builds up at the downstream edge of the applicator plate. The layer continuously breaks off harmlessly after reaching about 0.25 to 0.50 inch. The thin light layer of adhesive does not create streaking in the adhesive layer 37 which is applied to the web.

The shape of the narrow knife-edge can be achieved in many ways. It only needs to be narrow. Also, it is not necessary for the applicator plate to include the machined recess 53. The opening for allowing flow of adhesive can be provided in other ways, for example, by a separate piece with a thickness the same as recess 53.

While in the foregoing specification a detailed description of specific embodiments was set forth for the purpose of illustration, it will be understood that many of the details hereingiven may be varied considerably by those skilled in the art without departing from the spirit and scope of the invention.

We claim:

1. An applicator plate for an adhesive applicator apparatus for a core-making machine which applies adhesive to a web which moves from an upstream direction to a downstream direction, the applicator plate having a top portion, a bottom portion having a bottom surface, a pair of side surfaces, an upstream face which extends generally downwardly to the bottom surface for directing adhesive to the bottom surface, and a downstream face, the bottom surface extending from the upstream face beyond the downstream face and being adapted to spread adhesive on a web below the bottom surface, said bottom portion having a narrow wedge-shaped portion which extends in a downstream direction from said downstream face and which is defined by said bottom surface and by an upper surface which extends from said downstream face, said bottom surface and said upper surface forming an included angle of about 10° to about 20°.

2. The applicator plate of claim 1 in which said wedge-shaped portion extends for at least about 0.03 to about 0.11 inches from said downstream face.

3. The applicator plate of claim 2 in which the bottom surface has a dimension of about 0.070 to about 0.160 inches.

4. The applicator plate of claim 3 in which said bottom surface is substantially flat.

5. The applicator plate of claim 2 in which the wedge-shaped portion has a thickness of about 0.005 to about 0.065 inches at said downstream face.

6. The applicator plate of claim 5 in which said wedge-shaped portion has a downstream end which has a thickness of about 0.007 to about 0.011 inches.

7. The applicator plate of claim 5 in which said wedge-shaped portion has a downstream end which has a thickness of less than 0.025 inches.

8. The applicator plate of claim 1 in which the thickness of said wedge-shaped portion has a thickness of about 0.005 to about 0.065 inches at said downstream face.

9. The applicator plate of claim 8 in which said wedge-shaped portion has a downstream end which has a thickness of about 0.007 to about 0.011 inches.

10. The applicator plate of claim 8 in which said wedge-shaped portion has a downstream end which has a thickness of less than 0.025 inches.

11. An applicator plate for an adhesive applicator apparatus for a core-making machine which applies adhesive to a web which moves from an upstream direction to a downstream direction, the applicator plate having a top portion, a bottom portion having a bottom surface, a pair of side surfaces, an upstream face which extends generally downwardly to the bottom surface for directing adhesive to the bottom surface, and a downstream face, the bottom surface extending from the upstream face beyond the downstream face and being adapted to spread adhesive on a web below the bottom surface, said bottom portion having a narrow wedge-shaped portion which extends in a downstream direction from said downstream face and which is defined by said bottom surface and by an upper surface which extends from said downstream face, said wedge-shaped portion extending for at least about 0.03 to about 0.11 inches from said downstream face, said downstream face extending upwardly from said upper surface at an angle of about 90°.

12. An applicator plate for an adhesive applicator apparatus for a core-making machine which applies adhesive to a web which moves from an upstream direction to a downstream direction, the applicator plate having a top portion, a bottom portion having a bottom surface, a pair of side surfaces, an upstream face which extends generally downwardly to the bottom surface for directing adhesive to the bottom surface, and a downstream face, the bottom surface extending from the upstream face beyond the downstream face and being adapted to spread adhesive on a web below the bottom surface, said bottom portion having a narrow wedge-shaped portion which extends in a downstream direction from said downstream face and which is defined by said bottom surface and by an upper surface which extends from said downstream face, said downstream face extending upwardly from said upper surface at an angle of about 90°.

13. An applicator plate for an adhesive applicator apparatus for a core-making machine which applies adhesive to a web which moves from an upstream direction to a downstream direction, the applicator plate having a top portion, a bottom portion having a bottom surface, a pair of side surfaces, an upstream face which extends generally downwardly to the bottom surface for directing adhesive to the bottom surface, and a downstream face, the bottom surface extending from the upstream face beyond the downstream face and being adapted to spread adhesive on a web below the bottom surface, said bottom portion having a narrow wedge-shaped portion which extends in a downstream direction from said downstream face and which is defined by said bottom surface and by an upper surface which extends from said downstream face, said upstream face having substantially flat top and side portions and a recessed portion which extends downwardly to said bottom surface whereby adhesive may flow in the recessed portion to said bottom surface.

* * * * *